US008960277B2

(12) United States Patent
Braekke et al.

(10) Patent No.: US 8,960,277 B2
(45) Date of Patent: Feb. 24, 2015

(54) PACKER FOR SEALING AGAINST A WELLBORE WALL

(75) Inventors: Kristoffer Braekke, Stavanger (NO); Bård-Einar Angell, Sadnes (NO); Melanie Seguin, Stavanger (NO)

(73) Assignee: I-TEC AS, Stavanger (NO)

( * ) Notice: Subject to any disclaimer, the term of this patent is extended or adjusted under 35 U.S.C. 154(b) by 408 days.

(21) Appl. No.: 13/478,907

(22) Filed: May 23, 2012

(65) Prior Publication Data

US 2012/0298349 A1 Nov. 29, 2012

(30) Foreign Application Priority Data

May 25, 2011 (NO) ..... 20110769

(51) Int. Cl.
*E21B 33/12* (2006.01)
*E21B 33/128* (2006.01)

(52) U.S. Cl.
CPC ..... *E21B 33/1208* (2013.01); *E21B 33/128* (2013.01)
USPC ..... 166/202; 166/118; 166/121

(58) Field of Classification Search
CPC . E21B 33/12; E21B 33/1208; E21B 33/1212; E21B 33/128
USPC ..... 166/118, 387, 202, 191, 121
See application file for complete search history.

(56) References Cited

U.S. PATENT DOCUMENTS

| | | | | |
|---|---|---|---|---|
| 2,399,766 | A | 5/1946 | Steward | |
| 3,587,736 | A * | 6/1971 | Brown | 166/187 |
| 4,438,933 | A * | 3/1984 | Zimmerman | 277/337 |
| 4,765,405 | A * | 8/1988 | Clark | 166/186 |
| 5,678,635 | A * | 10/1997 | Dunlap et al. | 166/387 |
| 7,735,568 | B2 * | 6/2010 | Xu et al. | 166/387 |
| 7,789,138 | B2 * | 9/2010 | McGarian et al. | 166/191 |
| 2003/0098153 | A1 * | 5/2003 | Serafin | 166/202 |
| 2004/0182582 | A1 * | 9/2004 | Bosma et al. | 166/387 |
| 2008/0230236 | A1 * | 9/2008 | Wright et al. | 166/387 |

* cited by examiner

*Primary Examiner* — David Bagnell
*Assistant Examiner* — Tara Schimpf
(74) *Attorney, Agent, or Firm* — Marshall, Gerstein & Borun LLP

(57) ABSTRACT

A packer for sealing against an inner cylindrical mandrel and a wellbore wall.

8 Claims, 1 Drawing Sheet

PACKER FOR SEALING AGAINST A WELLBORE WALL

BACKGROUND

1. Technical Field

This invention relates to a packer for sealing against a wellbore wall.

2. Related and Prior Art

In the recovery of hydrocarbons, i.e. oil and/or gas, production wells are drilled through which hydrocarbons can be produced from a subsurface geological formation. In many cases, one or more injection wells are also drilled, into which fluid is injected for increasing the pressure and/or delivering chemicals to facilitate the production of hydrocarbons. Similar wells are drilled in geothermal plants as well.

Typically, a well is created by drilling a borehole into an earth formation using a drill string carrying a rotating drill bit, retrieving the drill string, lowering a casing into the borehole, and cementing the casing in place. When the cement has set, another smaller diameter drill bit is run through the casing to drill a further segment of the borehole and then retrieved, and then another casing is cemented in place in the formation. The process is repeated until a desired depth has been reached, which process additionally may include the drilling of offset wells, installation of valves, tubing, and other equipment. It is not always necessary to case the entire well.

The process of preparing a well for production is referred to as "completion," and a person skilled in the art will be able to ascertain several details which are not discussed in any detail herein. In the following, the term "wellbore" is used for referring to both an uncased, "open" borehole, as well as to a cased borehole. In both cases the inner surface of the wellbore, i.e. the wellbore wall, may have depressions or elevations therein due to, for example, holes knocked into the rock by the drill string, corrosion of a casing, or wax and lime deposits, also referred to as "scale."

A well may be divided into zones. For example, a wellbore could be drilled to penetrate two production layers, and be divided into two zones by plugs below and above the production layers as well as a plug between the layers. The plug seals off the annulus between an inner pipe and the wellbore wall. During the completion process, it may be desirable to supply sand or chemicals down the inner pipe into the lowermost zone. The plug located between the zones is then subject to a pressure from below. Thereafter the process is repeated for the next zone. The plug between the zones is then subject to a pressure from above. Thus, a plug serving this purpose is subject to pressure from both sides, and therefore has to seal in both directions. Additionally, regulations and standards exist which dictate that such plugs must seal in both directions. Wedge anchors for keeping the plug in place in the wellbore wall as well as other known components of the plug are not comprised by the present invention, and are therefore not described in any detail herein.

U.S. Pat. No. 2,399,766 (Steward, 1946) discloses a plug sealing against a pipe wall by means of an elastic sleeve which is compressed axially and thereby expands radially against the wellbore wall. If the wellbore wall contains depressions, the sleeve material on both sides of the depression will tend to pull the sleeve radially out from the depression and hence counteract the seal. Similarly, in the case of an elevation in the wellbore wall, the elastic material will try to pull the sleeve radially inwards in the vicinity of the elevation. In other words, an additional force is necessary to press an elastic sleeve into depressions and to prevent leakage around elevations. These problems are aggravated if the sleeve is made of a rigid rubber compound designed to resist high pressures and temperatures in the deep wells drilled nowadays. Steward also discloses numerous variants of setting mechanisms in which a leading screw and nut are rotated relative to each other to effect an axial movement between the screw and nut. The axial movement is used for activating wedge anchors in addition to the elastic sealing sleeve.

It is an object of the present invention to provide an improved seal between a mandrel and a wellbore wall. The mandrel may be compact and prevent any fluid flow therethrough, or be a pipe allowing fluid to flow through an inner, longitudinal passage in the mandrel.

SUMMARY OF THE INVENTION

The above object is achieved by a packer for sealing against an inner cylindrical mandrel and a wellbore wall, characterized by a packer element comprising at least two annular segments arranged coaxially and axially displaceable on the mandrel, each segment including an inner end having an inner seal against the mandrel and an outer end able to expand radially and slide axially over the inner end of a neighboring segment when said two annular segments are pressed axially towards each other, and an axially displaceable actuating piston connected to at least one segment, the actuating piston being able to exert an axial force which is sufficient to cause the outer end of the segment to slide over the inner end of the neighboring segment and expand radially into sealing contact with the wellbore wall.

In a preferred embodiment, the packer element includes two groups of segments oriented in opposing axial directions, the segments being made of an elastomer, typically a synthetic rubber compound. Alternatively, the segments may be made of a deformable material.

Segmenting the packer element into several annular segments may facilitate its adaptation to wellbore wall roughness, as well as the formation of several independent sealing surfaces.

BRIEF DESCRIPTION OF THE DRAWINGS

In the following, the invention is described in more detail with reference to the accompanying drawings, in which similar reference numbers refers to similar elements and in which.

DETAILED DESCRIPTION

Figure 1:
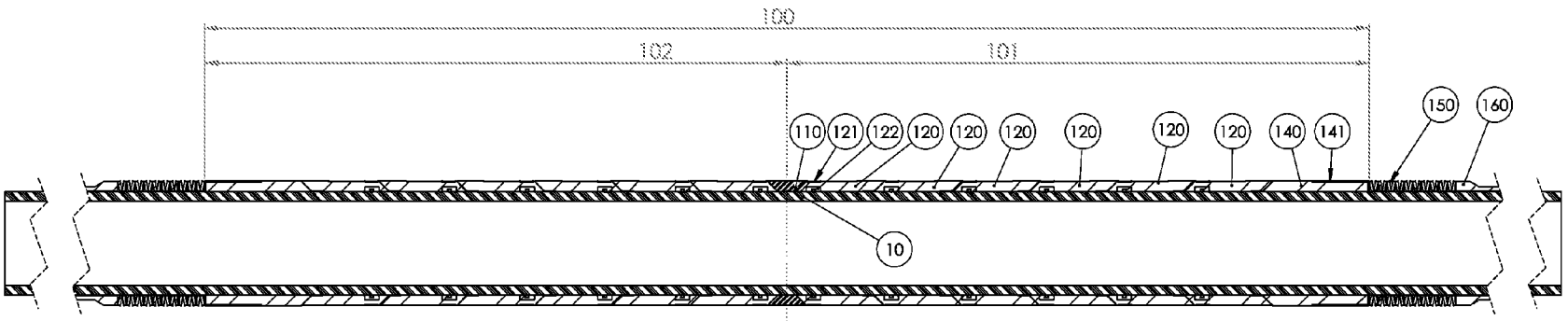
FIG. 1 is a schematic view of a packer element in a run-in configuration.
Figure 2:
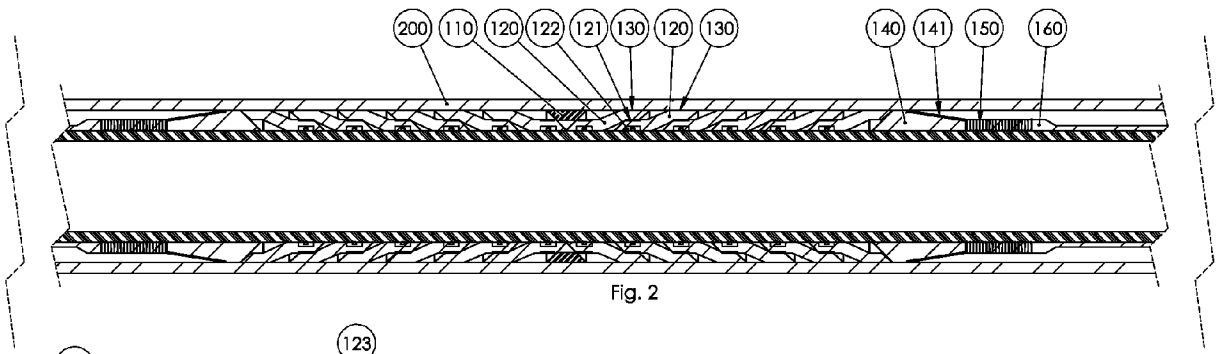
FIG. 2 shows the packer element of FIG. 1 in an expanded configuration against a wellbore wall.

FIG. 1 schematically shows a longitudinal section through a cylindrical packer element 100 arranged around a cylindrical mandrel 10. The packer element 100 assumes a non-expanded configuration used when the packer is run into the well. The mandrel 10 may be hollow, as shown in FIGS. 1 and 2, or may be massive as mentioned in the introductory section.

The packer element 100 includes a series of annular segments 120 sequentially positioned along the cylindrical mandrel 10. In the embodiment of FIGS. 1 and 2, the annular segments 120 are arranged symmetrically around a center part 110, in such a manner that the outer ends of the segments are facing away from center part 110.

Reference is now made to the one half 101 of the packer element 100 appearing to the right in FIG. 1, and to FIG. 3, showing an annular segment 120. Each segment 120 is provided with an inner seal 122 for sealing against the outer cylindrical surface of mandrel 10. Seal 122 is represented by two O-rings, but it should be understood that any seal which is able to resist a possible differential pressure across segment 120 and which is able to slide axially along the outer surface of mandrel 10 could be used in the invention. A clamping ring 121 prevents the inner end of the segment from moving radially and also squeezes the seal 122 against mandrel 10. The clamping ring 121 may be made of a suitable metal, such as properly graded steel, for example.

An end piece 140 including a supporting ring 141, a packet of Belleville springs 150, and an actuating piston 160, in said order, is arranged around mandrel 10 and axially outside of the series of segments 120. Each of the components is axially slidably supported on the outer surface of mandrel 10. When the actuating piston 160 moves axially towards center part 110, the series of segments 120 expands radially to form a seal against a wellbore wall 200, as shown in FIG. 2. It is understood that center part 110 is not important in achieving this effect, and that it is sufficient to have one movable actuating piston 160 at the one end of the packer element 100 and a stopper at the other end thereof.

End piece 140 has a steel supporting ring 141 for preventing the extrusion thereof into the annulus between the wellbore wall and mandrel 10 when the element 100 is exposed to the well pressures and temperatures. Supporting ring 141 does not in itself effect any seal against the wellbore fluid.

When the actuating piston is locked in the position shown in FIG. 2, Belleville springs 150 are compressed and act on end piece 140 with an axially directed force which is proportional with the compression (Hooke's law). If the elastomer used in segments 120 changes due to pressure or temperature conditions, or the inherent aging of a rubber compound exposed to the well environment, then Belleville springs 150 will compress packer element 100 even if the actuating piston 160 does not move.

Actuating piston 160 may be of any type known in the art, such as a hydraulic piston or a piston which is moved axially when a leading screw is rotated inside an internally threaded nut, for example. In many applications, however, the packer is to be permanently installed in the wellbore, e.g. between two production zones, so that a simple mechanism is preferred to a more complicated and expensive one. One example of such an embodiment is a hydraulically actuated actuating piston having a one-way mechanism, e.g. a ratchet mechanism, preventing the piston from moving backwards.

Reference is now made to FIG. 2, showing the overall configuration after the actuating piston 160 has been moved towards center part 110. The segments 120 are axially compressed and the outer ends of the segments have moved up and over the inner ends of the neighboring segments. The segments 120 have been radially expanded against the wellbore wall 200 by a force of sufficient magnitude to prevent fluid from passing through in the annulus between mandrel 10 and wellbore wall 200.

In the expanded configuration, the group 101 resembles a stack of cups threaded into each other with their openings facing actuating piston 160. In FIG. 2, it can be seen that if the pressure force is directed from actuating piston 160 towards center part 110, then the pressure will assist in pressing the segments tighter against the wellbore wall in the series of sealing surfaces 130.

A corresponding group 102 in which the segments are faced in the opposite direction, i.e. with the cups thereof opening to the left in FIGS. 1 and 2, will seal particularly well against a pressure differential from the left towards the right in FIGS. 1 and 2. Packer element 100, comprising both the first 101 and second 102 group of annular segments 120, hence provides an excellent seal regardless of the direction of the differential pressure across packer element 100.

An element 101 including a series of independent segments 120 also may seal better against rough surfaces than a continuous sleeve. The reason for this is that when an elastic sleeve is positioned above a depression, the material of the elastic sleeve on both sides of the depression will try to pull the sleeve out from the depression, preventing elastic material from entering into the depression to seal efficiently. The segments 120 are not secured to each other, and consequently neighboring segments will not act to pull material out from the depression in the same extent. Therefore, a single segment 120 will be more easily able to enter into a depression in the wellbore wall than will a continuous sleeve, so that a series of independent segments will achieve a better seal against the depression as compared with a continuous sleeve. Similarly, a series of independent segments 120 will be more easily able to surround an elevation in the wellbore wall as the segments are slightly movable relative to each other. The result is that, with the conditions being otherwise identical, a series of segments 120 provides a better seal against an uneven wellbore wall as compared with a continuous packer sleeve. Segmented packer elements as described herein, therefore, are well suited in open wellbores in which the earth formation surface may be rougher than the interior of a typical steel casing, or as a packer for an old pipe containing corrosion pits and deposits.

In one embodiment, the segments closest to center part 110 are made to be softer than the segments at a greater axial distance from center part 110. This is to make sure the segments closest to the center of packer element 100 will seal against the wellbore wall 200 before sealing is achieved by the more distal segments, so that the outermost segments will not make sealing contact first and thereby create unnecessarily high friction against the wellbore wall when the segments are moved towards each other while the plug is being set. To achieve this effect, it is of no significance whether the segments 120 closest to center part 110 have thinner walls than the segments further away from center part 110, whether the segments other-wise differ in design, whether they are made of different materials, or made with different rigidity in other manners known by a person skilled in the art.

Additionally, the use of stiffer segments at distance from center part 110 may also prevent extrusion of the softer segments along the longitudinal axis of the plug. Hence, both relatively soft segments which easily conform to depressions and elevations in the wellbore wall as well as stiffer segments able to resist higher pressures and temperatures can be used in same packer element.

Alternatively, segments 120 may be made of a material, such as lead, which deforms plastically when the packer element 100 is activated. Such an embodiment may be suited for plugs to be installed permanently in a well, or for cases in which the pressures and temperatures make it difficult to achieve an adequate seal using synthetic rubber compounds.

Figure 3B:
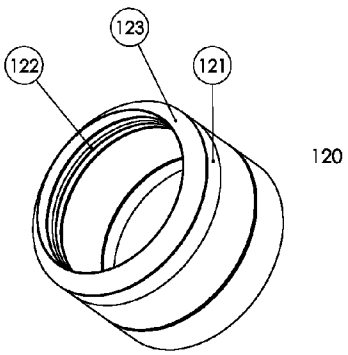
FIG. 3 shows a preferred embodiment of an annular segment.
Figure 3A:
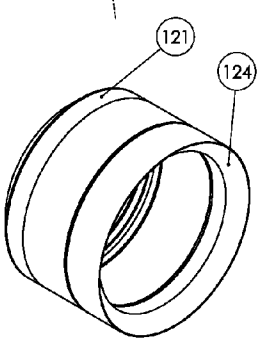

FIG. 3 (FIG. 3*a*-3*b*) shows a preferred embodiment of an annular segment 120 made of an elastomeric material, typically a synthetic rubber compound. The segment 120 includes an inner end having an outer frusto-conical sliding surface 123, and an outer end having an inner frusto-conical sliding surface 124. The sliding surfaces 123 and 124 have the same slope, allowing the outer end of a segment to easily slide over the inner end of a similar segment when the packer element 100 shown in FIGS. 1 and 2 is activated.

The inner end is also provided with an inner seal 122, shown as two axially spaced apart O-rings. Any other known seal capable of sliding axially on an outer cylindrical surface could be used.

A clamping ring 121 is positioned around the inner end of the elastic segment. The function of the clamping ring is to squeeze the inner end of the segment to bear against a cylindrical surface, and the ring may advantageously be made of steel or another suitable material so as to not expand excessively in a radial direction when the segment is subject to pressure.

With this, a packer element 101 including a series of segments 120 provides a sequence of sealing surfaces against mandrel 10 at each seal 122 as well as against the wellbore wall at abutment faces 130, and therefore will be able to resist many small differential pressures, or a large total differential pressure from one side, while a similar element 102 is able resist a corresponding differential pressure acting in the other direction along the axis of the plug. Hence, packer element 100 provides an improved seal within a wellbore.

The invention claimed is:

1. A packer for sealing against an inner cylindrical mandrel and a wellbore wall, comprising:

a packer element comprising at least two annular segments coaxially and axially displaceably disposed on the mandrel, and an axially displaceable actuating piston connected with at least one segment, wherein each segment comprises an inner end having an inner seal against the mandrel and an outer end being able to expand radially and slide axially over the inner end of a neighboring segment when the two annular segments are pressed axially against each other, wherein the actuating piston is able to exert an axial force of sufficient magnitude to cause the outer end of the segment to slide over the inner end of the neighboring segment and to expand radially into sealing contact with the wellbore wall, and wherein different segments have different rigidities or rigidness such that the segments are softer with increasing distance from the actuating piston.

2. The packer of claim 1, wherein the packer element comprises a first and second group of annular segments, the inner ends of the first group being oriented in an axially opposite direction of the inner ends of the second group.

3. The packer of claim 2, wherein a center part is disposed between the first and second group of segments.

4. The packer of claim 1, wherein a clamping ring is positioned around and into contact with the inner end of the segments.

5. The packer of claim 1, wherein the segments comprise an annular body made of an elastic material.

6. The packer of claim 1, wherein a spring package is disposed between the actuating piston and a group of segments.

7. The packer of claim 1, wherein an end piece comprising a supporting ring is provided at an end of a group of segments.

8. The packer of claim 1, wherein the segments are made of a deformable material.

* * * * *